US006442363B2

(12) United States Patent
Chae et al.

(10) Patent No.: US 6,442,363 B2
(45) Date of Patent: Aug. 27, 2002

(54) LIQUID ELECTROPHOTOGRAPHIC PRINTING APPARATUS AND METHOD WHEREIN LIQUID CARRIER ABSORPTION AND DISCHARGE BETWEEN ROLLERS AND PHOTOSENSITIVE MEDIUM CAN REACH EQUILIBRUIM

(75) Inventors: Seong-joon Chae, Seoul; Joong-gwang Shin, Pucheon; Dong-hwan Kang, Suwon; Hyun-gu Woo, Seoul, all of (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/790,717

(22) Filed: Feb. 23, 2001

(30) Foreign Application Priority Data

Feb. 24, 2000 (KR) ..... 00-9087

(51) Int. Cl.[7] ..... G03G 15/10
(52) U.S. Cl. ..... 399/237; 399/238
(58) Field of Search ..... 399/237, 238, 399/239, 246, 247, 249, 250, 251; 347/7, 89, 93

(56) References Cited

U.S. PATENT DOCUMENTS 5,978,631 A * 11/1999 Lee ..... 399/251
6,101,356 A * 8/2000 Kim et al. ..... 399/250
6,311,034 B1 * 10/2001 Nakashima et al. ..... 399/239

* cited by examiner

*Primary Examiner*—Sophia S. Chen
*Assistant Examiner*—Hoan Tran
(74) *Attorney, Agent, or Firm*—Sughrue Mion, PLLC

(57) ABSTRACT

In a printing apparatus including a drying roller for absorbing a liquid carrier remaining on a photosensitive medium, a transfer roller for transferring an image on the photosensitive medium to a recording paper sheet, and a carrier supply unit for supplying liquid carrier to the drying roller, the transfer roller, and the photosensitive medium, a printing operation is carried out such that the carrier is supplied to the drying roller, the transfer roller, and the photosensitive medium to wet them so that carrier absorption and discharge between the transfer roller, the drying roller, and the photosensitive medium can reach equilibrium states.

20 Claims, 9 Drawing Sheets

LIQUID ELECTROPHOTOGRAPHIC PRINTING APPARATUS AND METHOD WHEREIN LIQUID CARRIER ABSORPTION AND DISCHARGE BETWEEN ROLLERS AND PHOTOSENSITIVE MEDIUM CAN REACH EQUILIBRUIM

BACKGROUND OF THE INVENTION

1. Field of the Invention

The present invention relates to a liquid electrophotographic printing apparatus, and a printing method thereof.

2. Description of the Related Art

In general, a liquid electrophotographic printing apparatus such as a laser color printer or copier uses a developer liquid mixture of toner particles and a liquid NORPAR solvent as a developing carrier. In this case, the toner comprises a pigment of a predetermined color, an organosol combining with the pigment, and the like.

FIG. 1 shows an example of a liquid electrophotographic printing apparatus. As shown in FIG. 1, a printing apparatus is comprised of a photosensitive belt 10 circulating while supported by a plurality of support rollers 11, development units 13, which correspond to the colors of yellow (Y), cyan (C), magenta (M), and black (K), for developing an electrostatic latent image formed on the photosensitive belt 10 with developer liquid and forming a toner image, a drying unit 15 having a drying roller 15*a* and a heating roller 15*b* for drying the toner image, and a transfer unit 17 for transferring the dried toner image to a recording paper sheet P.

In the liquid electrophotographic printing apparatus configured as described above, during a printing operation, after the photosensitive belt 10 is initialized by an eraser device 12 while circulating in one direction, the photosensitive belt 10 is charged by a charger 14 to a predetermined level. On the charged surface of the photosensitive belt 10, an electrostatic latent image corresponding to predetermined image data is formed by a scanning light beam emitted from each of a plurality of laser scanning units 16. The electrostatic latent image is developed by a developer liquid supplied by a development roller 13*a* of each of the development units 13, and then the developer liquid applied to the electrostatic latent image is squeezed by a squeeze roller 13*b*. The toner in the developer liquid is formed to be a film and forms a toner image, and most of the remaining NORPAR is squeezed by the squeeze roller and is removed from the photosensitive belt 10.

The drying roller 15*a* absorbs NORPAR remaining in the filmy toner image while rotated by frictional contact with the photosensitive belt 10. The absorbed NORPAR is heated and evaporated by the heating 15*b*. Then, the toner image dried to be appropriate for image transfer is transferred to a transfer roller 17*a* due to a difference in surface energies of the photosensitive belt 10 and the transfer roller 17*a*. The toner image transferred to the transfer roller 17*a* is finally transferred to a recording paper sheet P passing between a fuser roller 17*b* and the transfer roller 17*a*.

In addition, when the liquid electrophotographic printing apparatus as described above performs a printing operation at an initial stage, or performs a printing operation after a predetermined time has passed since a printing operation was performed, the liquid electrophotographic printing apparatus is driven in a state in which the drying roller 15*a*, the transfer roller 17*a*, and the photosensitive belt 10 are dried.

Therefore, the drying roller in a dried state excessively absorbs NORPAR on the photosensitive belt 10 at an early stage, and, in this process, an error in which a toner image is picked by the drying roller 15*a* occurs. In addition, since the transfer roller 17*a* in a dried state tends to absorb a liquid component from the toner image transferred from the photosensitive belt 10, the transfer roller 17*a* instantaneously exerts a strong absorbing force against the toner image, and cannot normally transfer the toner image to a recording sheet P.

In addition, when developer liquid is supplied to the photosensitive belt 10 in a dried state for forming an image, NORPAR of newly supplied developer liquid is absorbed to the dried toner remaining on the photosensitive belt 10 when the previous printing operation is terminated, and a pigment of a toner and an organosol of newly supplied developer liquid adhere onto the dried toner. In this case, since an attraction force between the same materials greatly acts between the dried toner and the newly supplied toner, at an early stage of a printing operation, a toner image formed on the photosensitive belt is not normally transferred to the transfer roller 17*a*. In addition, there is a problem in which as a toner of newly supplied developer liquid repeatedly adheres to a remaining dried toner layer, and forms an accumulated layer, the photosensitive belt 10 gradually deteriorates and the usable life of the photosensitive belt 10 shortens.

SUMMARY OF THE INVENTION

To solve the above problems, it is an objective of the present invention to provide a liquid electrophotographic printing apparatus capable of keeping carrier contents of a drying roller, a transfer roller, and a photosensitive belt in a balanced state by supplying carrier the drying roller, transfer roller, and photosensitive belt before a development mode begins, and a printing method thereof.

Accordingly, to achieve the above objective, there is provided a liquid electrophotographic printing apparatus comprising a photosensitive medium on one surface of which an image is formed; a drying roller installed to detachably contact the photosensitive medium for absorbing a liquid carrier remaining on the photosensitive medium when contacting the photosensitive medium; and a transfer roller which is installed to detachably contact the photosensitive medium, to which the image formed on the photosensitive medium is operative to be transferred when the transfer roller contacts the photosensitive medium, and which transfers the image transferred from the photosensitive medium to a recording paper sheet, wherein the printing apparatus further comprises a carrier supply means for supplying a liquid carrier to the drying roller, the transfer roller, and the photosensitive medium, and is adapted so that the rollers and the photosensitive medium can be wetted by the liquid carrier before the image is formed on the photosensitive medium, and carrier absorption and discharge between the rollers and the photosensitive medium are operative to reach equilibrium states.

To achieve the above objective, there is also provided a printing method of a liquid electrophotographic printing apparatus including the steps of warming up the printing apparatus by checking various devices in the printing apparatus while a drying roller and a transfer roller are separated from a photosensitive medium; and developing an electrostatic latent image formed on the photosensitive medium with developer liquid to form an image, wherein the printing method further includes the step of supplying a liquid carrier to the rollers and the photosensitive medium so that the rollers and the photosensitive medium are wetted by the liquid carrier before the developing step.

BRIEF DESCRIPTION OF THE DRAWINGS

The above objectives and advantages of the present invention will become more apparent by describing in detail preferred embodiments thereof with reference to the attached drawings, in which.

DETAILED DESCRIPTION OF THE PREFERRED EMBODIMENTS

Figure 1:
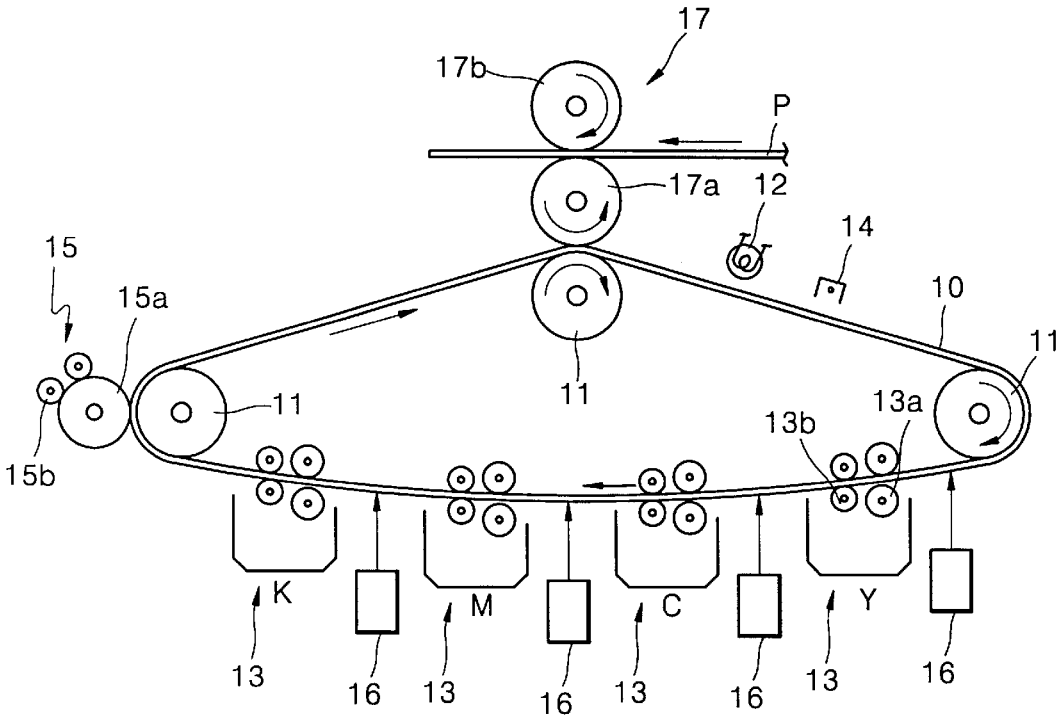
FIG. 1 (PRIOR ART)
FIG. 1 is a schematic diagram illustrating a general liquid electrophotographic printing apparatus.
Figure 2:
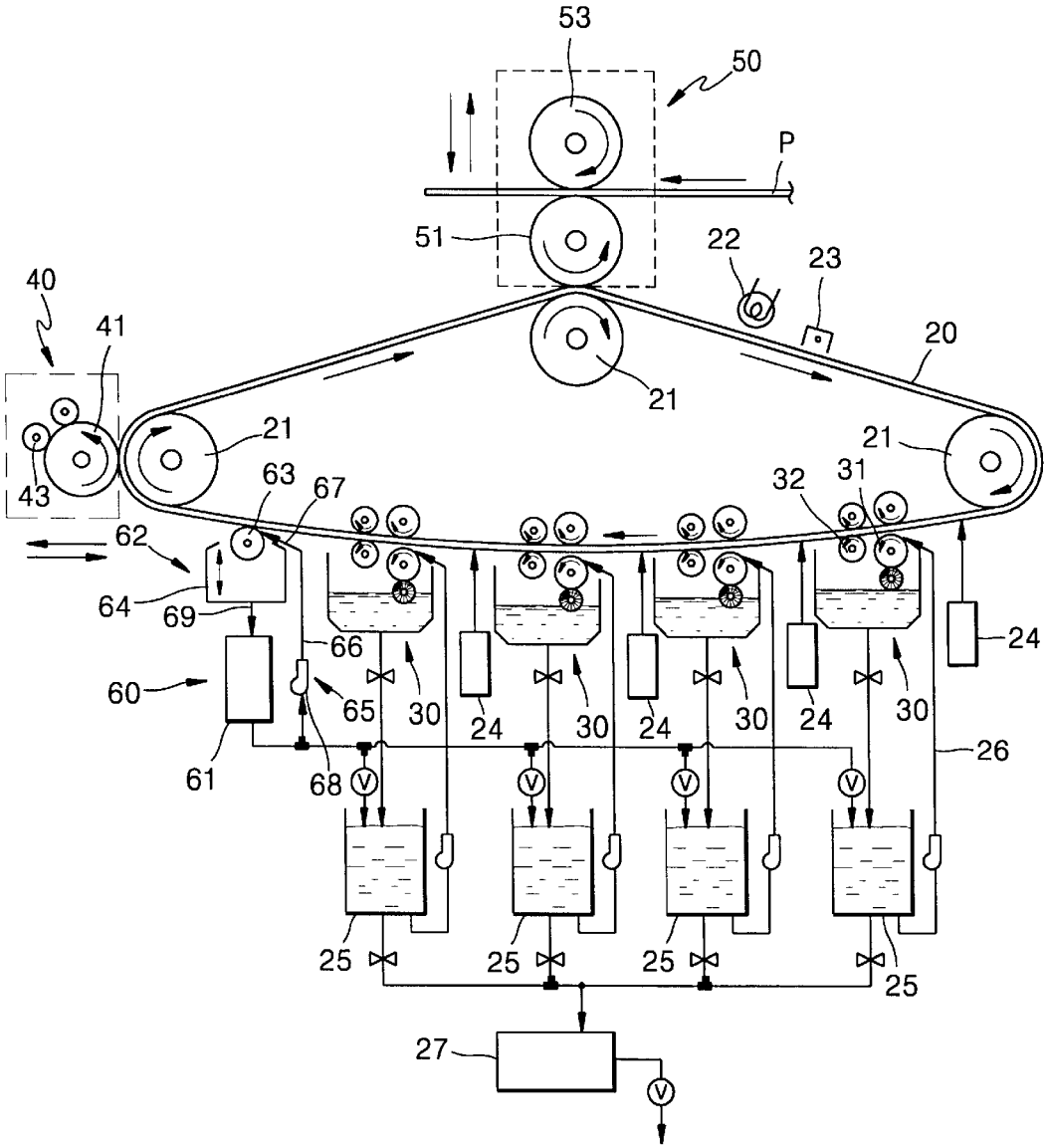
FIG. 2 is a schematic diagram illustrating a liquid electrophotographic printing apparatus according to one embodiment of the present invention.

Referring to FIG. 2, a liquid electrophotographic printing apparatus according to one embodiment of the present invention comprises a photosensitive belt 20 supported by a plurality of support rollers 21 to be capable of circulating around the plurality of support rollers 21, development units 30 for forming respective images on the photosensitive belt 20, a drying unit 40 for drying liquid NORPAR remaining on the photosensitive belt 20, a transfer unit 50 for transferring a toner image formed on the photosensitive belt 20 to a recording paper sheet P, a NORPAR supply means 60 for supplying NORPAR to the drying unit 40, a transfer unit 50, and photosensitive belt 20 before the toner image is formed.

The photosensitive belt 20 is a photosensitive medium on which a toner image is formed, is initialized by an eraser device 22 installed at one side of the photosensitive belt 20, and is charged by a charger 23 to a predetermined level. In addition, one surface of the photosensitive belt 20 is selectively exposed to scanning light emitted from each of laser scanning units 24 according to image data, and an electrostatic latent image is formed on the photosensitive belt 20.

The development units 30 are provided corresponding to colors of yellow, cyan, magenta, and black, and each unit comprises respective development rollers 31, squeeze rollers 32, and the like. The development roller 31 develops the electrostatic latent image with developer liquid supplied from a predetermined ink delivery system, and the squeeze roller 32 squeezes developer liquid remaining on the photosensitive belt 20.

In this case, the developer liquid is a mixture of toner comprising predetermined color pigment and a organosol, and a liquid carrier, e.g., NORPAR, acting as a solvent. Such developer liquid is supplied from working solution tanks 25 individually installed in the printing apparatus corresponding to respective colors to development units 30 via delivery paths 26. In addition, the developer liquid in the working solution tanks 25 is replenished by supplying NORPAR and toner from a NORPAR tank 61 installed in the printing apparatus and toner tanks (not shown) to the working solution tanks 25, respectively, and mixing them in the working solution tanks 25. In addition, waste developer liquid in the working solution tanks 25 is recovered to a waste tank 27 separately provided in the printing apparatus.

The drying unit 40 is intended to remove liquid NORPAR remaining on the photosensitive belt 20, and comprises a drying roller 41 and a heating roller 43. The drying roller 41 is installed to detachably contact the photosensitive belt 20. In addition, when the printing apparatus is in a development mode, the drying roller 41 absorbs the NORPAR remaining on the photosensitive belt 20 while contacting the photosensitive belt 20 and rotated by the photosensitive belt 20. To this end, a NORPAR absorbing layer which has a predetermined thickness and is made of a material such as silicone is provided around the circumferential surface of the drying roller 41. On the other hand, the heating roller 43 heats the drying roller 41, and evaporates the NORPAR absorbed in the drying roller 41.

The transfer unit 50 comprises a transfer roller 51 rotating while contacting the photosensitive belt 20, and a fuser roller 53 pressing against the transfer roller 51. Also, the transfer unit 50 is installed to detachably contact the photosensitive belt 20. When the printing apparatus is in the development mode, the transfer roller 51 rotates while contacting the photosensitive belt 20, and the image dried to be appropriate for image transfer by the drying unit is transferred from the photosensitive belt 20 to the transfer roller 51 due to a difference in surface energies of the photosensitive belt 20 and the transfer roller 51. Subsequently, the toner image transferred to the transfer roller 51 is again transferred to a recording paper sheet P passing between the transfer roller 51 and the fuser roller 53. The transfer roller 51 has an external elastic layer of a predetermined thickness made of a material such as silicone so that a contact nip can be formed between the photosensitive belt 20 and the fuser roller 53 for smooth image transfer.

The NORPAR supplying means 60 comprises the NORPAR tank 61 for storing liquid NORPAR, a NORPAR applying portion 62 for coating the surface of the photosensitive belt 20 with the NORPAR in the NORPAR tank 61, a NORPAR spraying portion 65 for spraying the NORPAR which is stored in the NORPAR tank 61 to a location between the NORPAR applying portion 62 and the photosensitive belt 20, and a NORPAR recovery portion.

The NORPAR tank 61 is a place for storing the NORPAR to be supplied to the working solution tank 25, as described above, and is fixed to a predetermined place in the printing apparatus. In addition, the NORPAR in the NORPAR tank 61 is replenished from a predetermined NORPAR cartridge (not shown) installed at the outside of the printing apparatus.

The NORPAR applying portion 62 comprises a NORPAR supply roller 63 installed to be raised or lowered under the photosensitive belt 20, and a NORPAR bath 64 installed below the NORPAR supply roller 63 to surround the NORPAR supply roller 63. The NORPAR supply roller 63 is disposed to maintain a minute gap with the photosensitive belt 20 when the NORPAR supply roller 63 is raised, and coats the photosensitive belt 20 with the NORPAR supplied to the gap while rotating in the traveling direction of the photosensitive belt 20. As a matter of course, differing from the above-described one, the NORPAR supply roller 63 may be disposed to directly contact the photosensitive belt 20 so that the NORPAR covering the circumferential surface of the NORPAR supply roller 63 can wet the photosensitive belt 20. The NORPAR bath 64 receives the NORPAR flowing over the circumferential surface of the NORPAR supply roller 63. The NORPAR bath 64 may be raised together with the NORPAR supply roller 63. In addition, it is preferable that the NORPAR applying portion 62 is installed between the drying roller 41 and the development units 30 so as to prevent the NORPAR coated on the photosensitive belt 20 from flowing to the development units 30.

The NORPAR spraying portion 65 comprises a NORPAR supply path 66 for connecting the NORPAR tank 61 and the NORPAR applying portion 62, a spray nozzle 67 provided at the leading end of the NORPAR supply path 66 for spraying NORPAR into the gap between the NORPAR supply roller 63 and the photosensitive belt 20, a pump 68 installed in the NORPAR supply path 66 for pumping the NORPAR which is stored in the NORPAR tank 61.

The NORPAR recovery portion is intended to recover the NORPAR gathering in the NORPAR bath 64 and return it to the NORPAR tank 61, and comprises a NORPAR return path 69 for connecting the NORPAR bath 64 and the NORPAR tank 61.

A printing method of the liquid electrophotographic printing apparatus configured as described above according to one embodiment of the present invention will be described in detail with reference to FIGS. 2 through 5.

Figure 3:
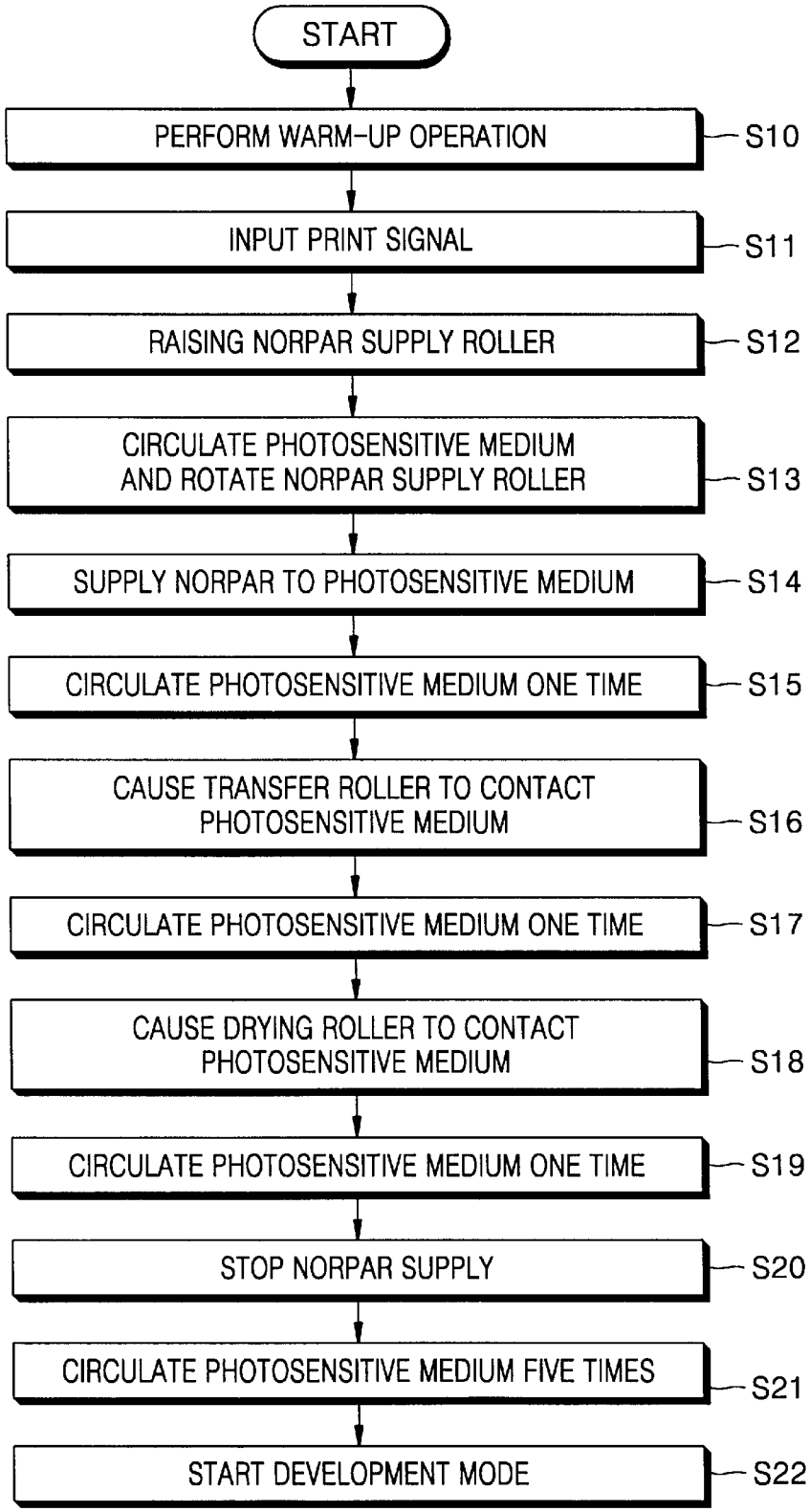
FIG. 3 is a flow chart illustrating a printing method of a liquid electrophotographic printing apparatus according to one embodiment of the present invention.
Figure 4:
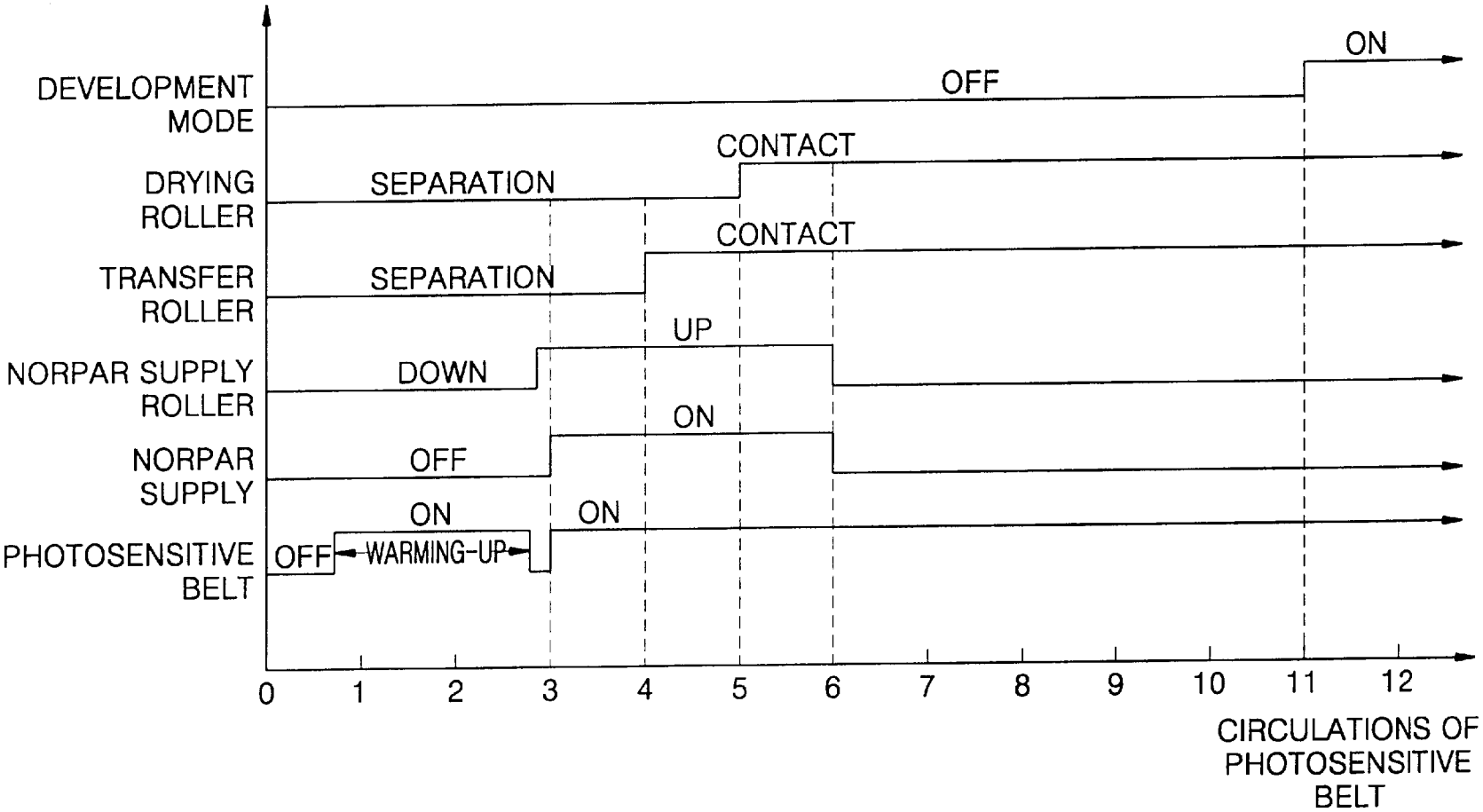
FIG. 4 is a timing chart illustrating the printing method according to the flow chart shown in FIG. 3 in connection with circulations of a photosensitive belt.

First, referring to FIGS. 2, 3, and 4, when the printing apparatus is turned on, or whenever a predetermined period passes by in a print ready mode, the printing apparatus performs a warm-up operation for checking various devices in the printing apparatus by itself while circulating the photosensitive belt 20 two or three times (S10). After this warm-up operation (S10) is completed, the photosensitive belt 20 stops circulating. At this time, when a print signal is input (S11), the NORPAR supply roller 63 is raised simultaneously with the print signal input, and nearly contacts the photosensitive belt 20 (S12). In addition, simultaneously, the photosensitive belt 20 rotates again, the NORPAR supply roller 63 rotates in the direction of circulation of the photosensitive belt 20 (S13). At this time, as shown in solid lines in FIG. 5, the drying roller 41 and the transfer roller 51 are separated from the photosensitive belt 20. At this stage, the NORPAR supply roller 63 may contact the photosensitive belt 20, and be rotated by the photosensitive belt 20, or may be rotated by a driving source (not shown).

Subsequently, the NORPAR supply roller 63 and the photosensitive belt 20 are rotated, the pump 68 is driven to spray the NORPAR from the NORPAR tank in between the photosensitive belt 20 and the NORPAR supply roller 63 (S14). Then, a portion of the sprayed NORPAR is thinly coated on the whole surface of the photosensitive belt 20 by the NORPAR supply roller 63. Therefore, the surface of the photosensitive belt 20 which was in a dried state before the printing apparatus is operated is wetted by NORPAR, and swells. At this time, the photosensitive belt 20 is circulated at least one time so that NORPAR can be uniformly supplied to the whole surface of the photosensitive belt 20 (S15).

Subsequently, as shown in an imaginary line in FIG. 5, the transfer roller 51 is moved to contact the photosensitive belt 20 (S16). Thereafter, the photosensitive belt 20 is circulated at least one time with the transfer roller 51 contacting the photosensitive belt 20 (S17). Then, a portion of the NORPAR supplied to the photosensitive belt 20 is transferred to the transfer roller 51, and wets the transfer roller 51. In addition, while the photosensitive belt 20 is circulated one time, the transfer roller 51 contacts the photosensitive belt 20 and rotates, and NORPAR absorption and discharge between them reach a nearly equilibrium state.

Figure 5:
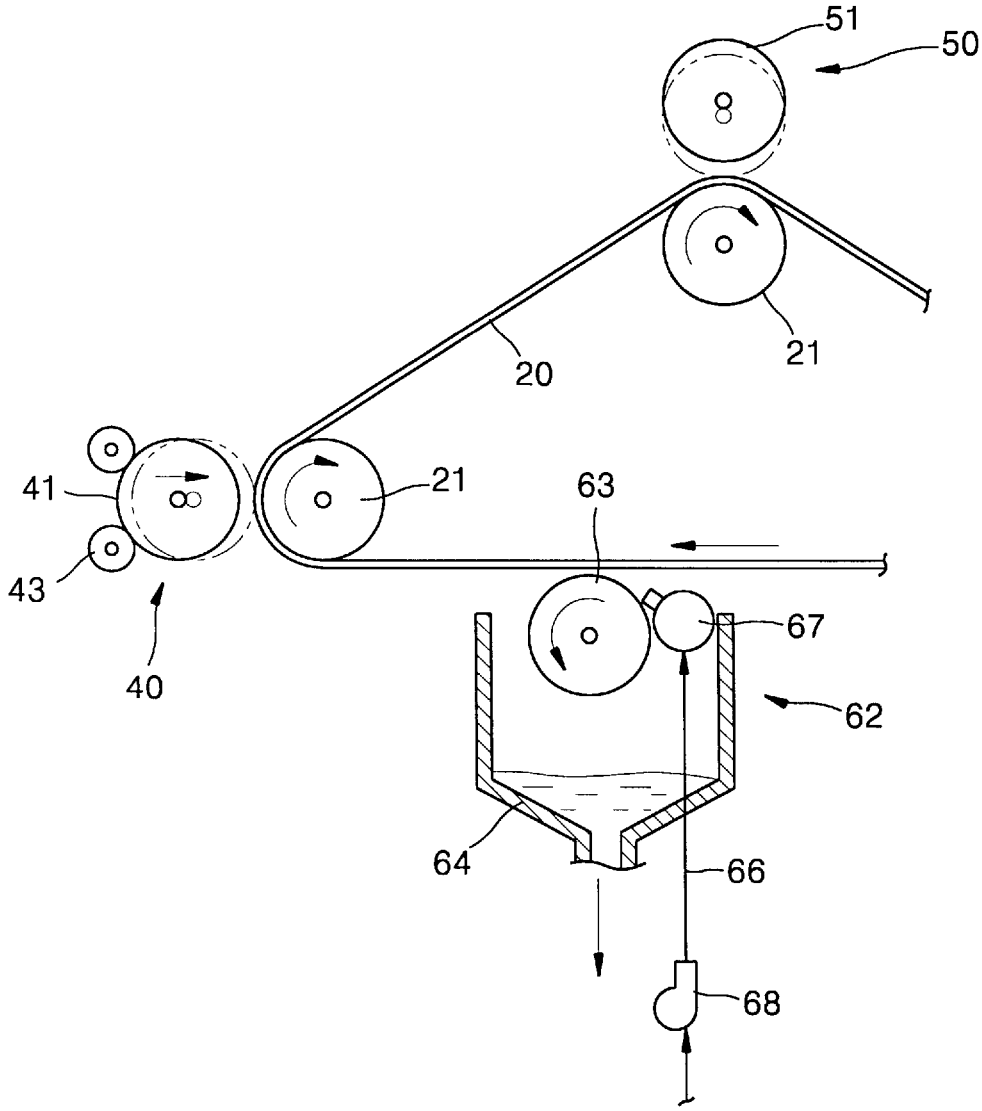
FIG. 5 is a schematic diagram illustrating a state of supplying NORPAR to the photosensitive belt in the printing apparatus shown in FIG. 2.

Thus, after NORPAR is supplied to the transfer roller 51 to some extent, in this turn, the drying roller 41 is caused to contact the photosensitive belt 20 as shown in an imaginary line in FIG. 5 (S18). Then, as the drying roller 41 rotates while contacting the photosensitive belt 20, the drying roller 41 absorbs a portion of NORPAR supplied to the photosensitive belt 20. At this time, when the photosensitive belt 20 is circulated at least one time (S19), the whole circumferential surface of the drying roller 41 is nearly uniformly wetted by NORPAR. In addition, NORPAR absorption and discharge between the drying roller 41 and the photosensitive belt 20 reach a nearly equilibrium state. In this state, the photosensitive belt 20, the drying roller 41, and the transfer roller 51 are not in dried states any more, and are in states wetted by NORPAR to some extent.

In addition, as described above, while NORPAR is supplied to the rollers 41 and 51, and the photosensitive belt 20, the rest of the NORPAR not delivered to the photosensitive belt 20 after being sprayed from the spray nozzle 67 falls and gathers in the NORPAR bath 64, and the NORPAR gathering in the NORPAR bath 64 is received again in the NORPAR tank 61 via the NORPAR return path 69.

In the states wherein the rollers 41 and 51, and the photosensitive belt 20 are wetted by NORPAR, it is preferable that the quantities of the NORPAR absorbed in the rollers 41 and 51 are balanced so that NORPAR absorption and discharge between the rollers 41 and 51 and the photosensitive belt 20 can reach equilibrium states. To this end, first, the pump 68 is stopped to break the supply of NORPAR, and the NORPAR supply roller 63 is lowered (S20). Thereafter, the photosensitive belt 20 is circulated, preferably about 5 times (S21). Then, while the photosensitive belt 20 circulates and the transfer roller 51 and the drying roller 41 contact the photosensitive belt 20 and rotate, NORPAR absorption and discharge between them reach equilibrium states. In addition, the rollers 41 and 51 and the photosensitive belt 20 are thinly coated by NORPAR to be appropriate for performing a normal developing operation. Therefore, the developing operation is performed in such states (S22), conventional errors such as contamination of the photosensitive belt 20, image picking, and imperfect image transfer do not occur.

That is, NORPAR absorption and discharge between the rollers 41 and 51, and the photosensitive belt 20 are maintained in equilibrium states, the rollers 41 and 51, and the photosensitive belt 20 do not excessively absorb at an early stage of the developing operation. Therefore, an occurrence of image picking by the drying roller 41 is restrained, imperfect image transfer which occurs when the transfer roller 51 is in a dried state can be restrained. In addition, since pure NORPAR is supplied to the photosensitive belt 20 in advance, newly supplied developer liquid is restrained from accumulating on the previous accumulated toner which forms a rigid coating on the photosensitive belt 20. Therefore, contamination of the photosensitive belt 20 can be prevented, and shortening of its usable life can be restrained.

Figure 6:
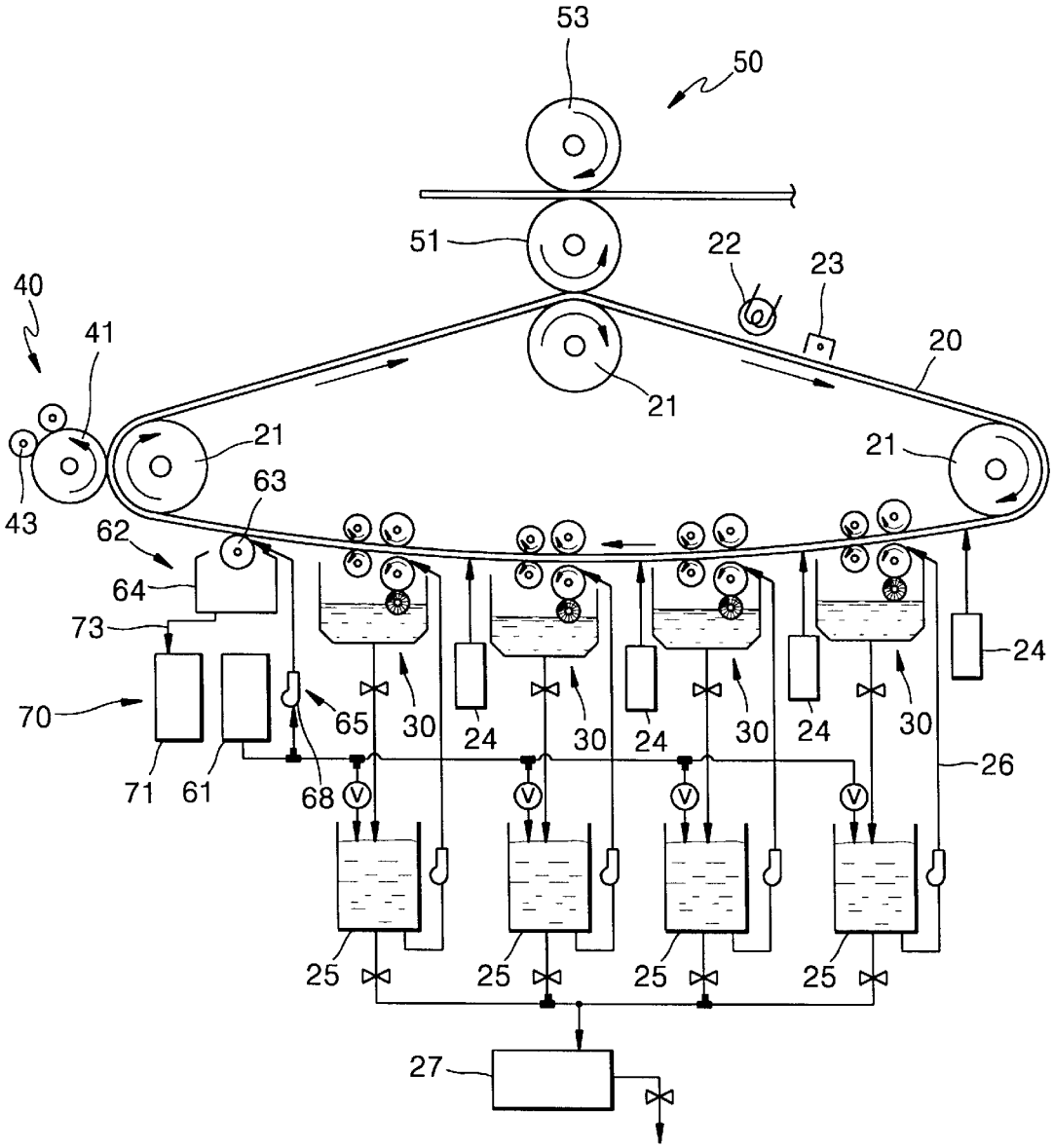
FIG. 6 is a schematic diagram illustrating a liquid electrophotographic printing apparatus according to another embodiment of the present invention.

FIG. 6 is a schematic diagram illustrating a liquid electrophotographic printing apparatus according to another embodiment of the present invention. In this case, the same reference numerals used previously to denote members of the embodiment shown in FIG. 2, are used here to denote similar members having similar functions.

Referring to FIG. 6, a NORPAR recovery portion 70 is intended to recover the NORPAR gathering in a NORPAR bath 64 of the NORPAR supplied to a photosensitive belt 20, and comprises a NORPAR recovery tank 71 and a recovery path 73. The NORPAR recovery tank 71 is provided in the printing apparatus separately from a NORPAR tank 61. In addition, the NORPAR recovery tank 71 is connected to the NORPAR bath 64 via the recovery path 73. Therefore, the NORPAR gathering in the NORPAR bath 64 is recovered to the NORPAR recovery tank 71 via the recovery path 73. Thereafter, the NORPAR recovered to the NORPAR recovery tank 71 may be reused after a filtering process, or may be disposed of via a predetermined path.

Figure 7:
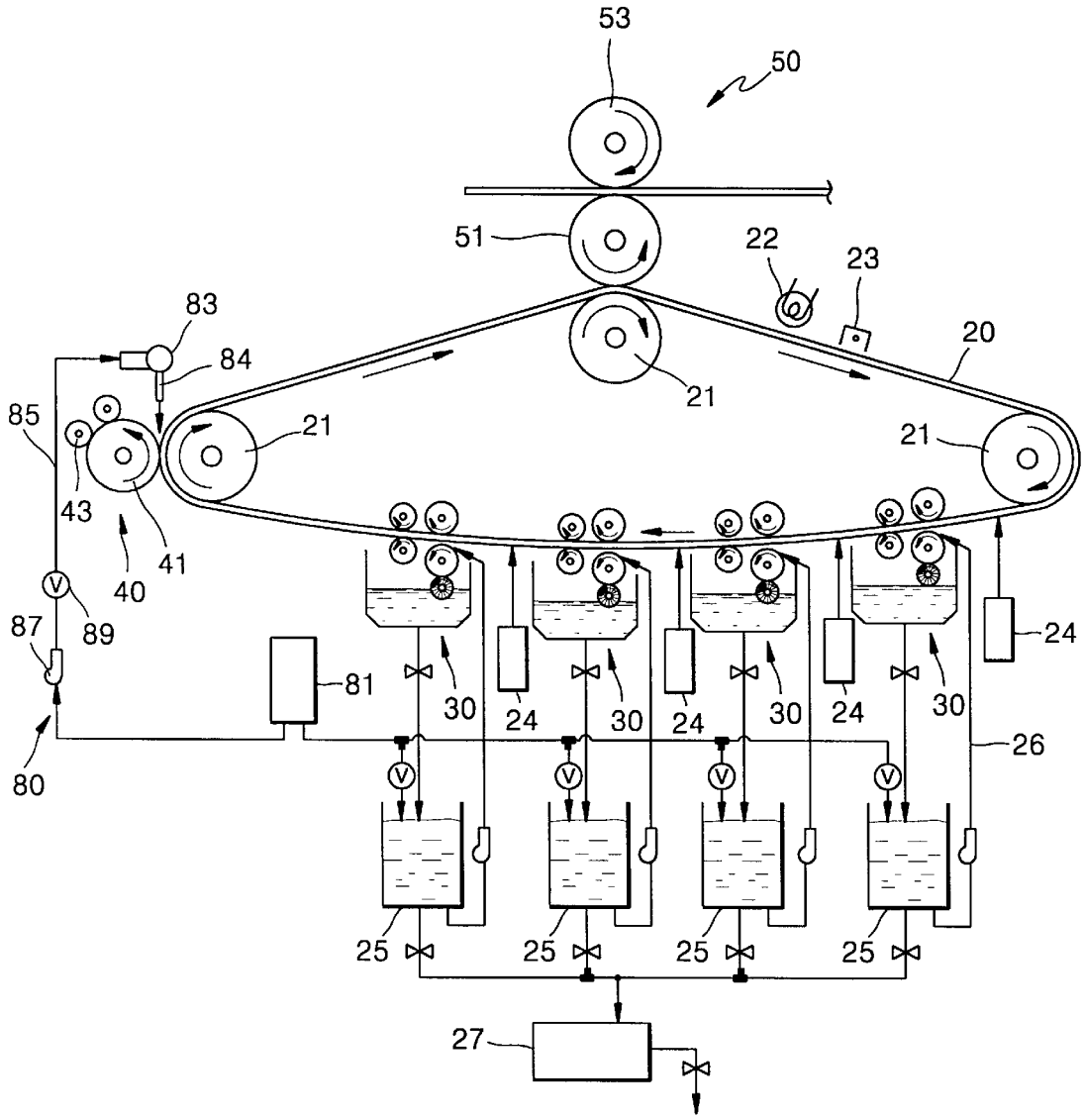
FIG. 7 is a schematic diagram illustrating a liquid electrophotographic printing apparatus according to still another embodiment of the present invention.
Figure 8:
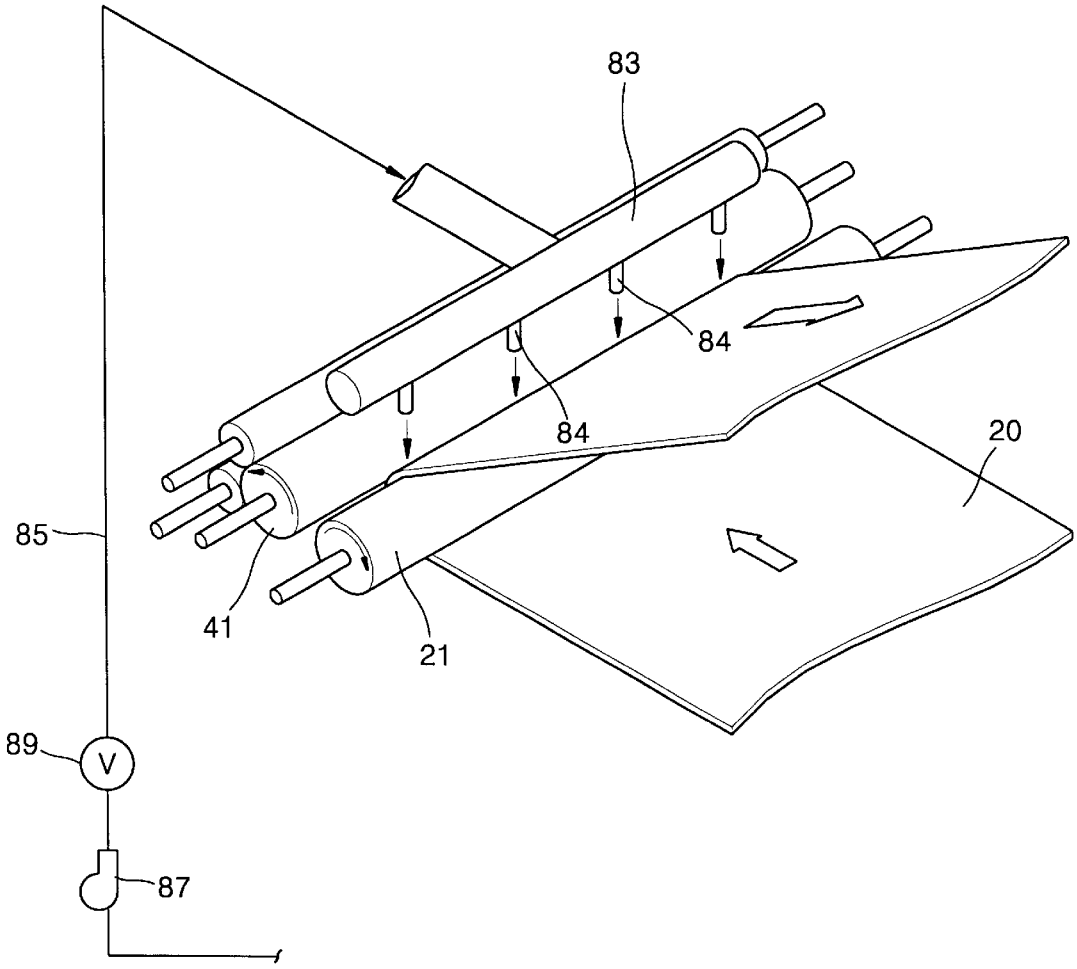
FIG. 8 is a perspective view illustrating an essential portion of FIG. 7.
Figure 9:
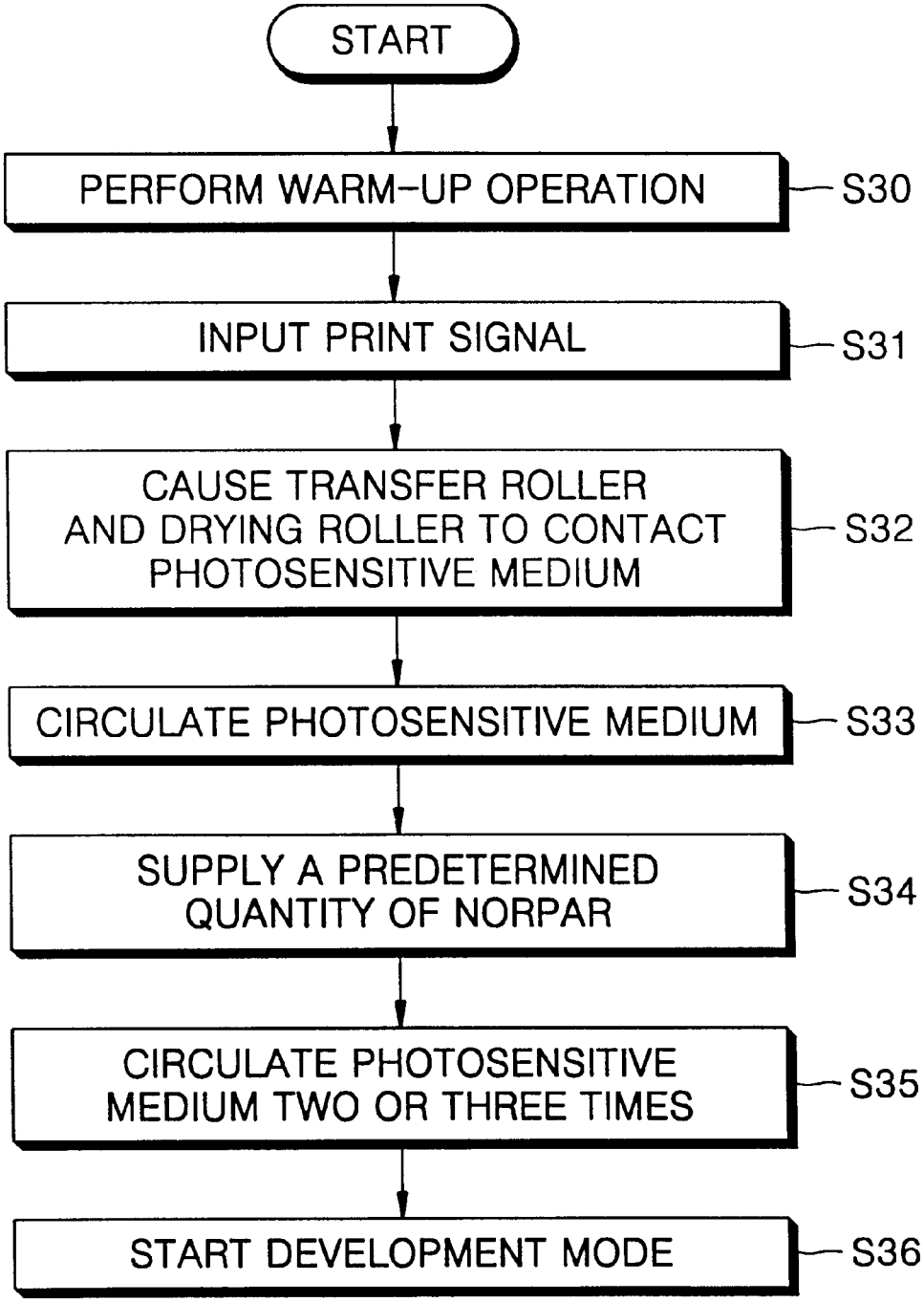
FIG. 9 is a flow chart illustrating a printing method using the printing apparatus shown in FIG. 7.

Referring to FIGS. 7–9, in a liquid electrophotographic printing apparatus according to still another embodiment of the present invention, a NORPAR supply means 80 comprises a NORPAR tank 81 for storing NORPAR, a spray nozzle 83 for spraying NORPAR in the NORPAR tank 81 to the contact portion of a drying roller 41 and a photosensitive belt 20, a NORPAR supply line 85 for connecting the spray nozzle 83 and the NORPAR tank 81, and a pump 87 and a valve 89 installed along the NORPAR supply line 85.

The NORPAR tank 81 is fixedly disposed in the printing apparatus, and liquid NORPAR to be supplied to a working solution tank 25 and the spray nozzle 83 is stored in the NORPAR tank 81. As best shown in FIG. 8, the spray nozzle 83 has a plurality of nozzle tubes 84 installed to be equidistantly spaced in a lengthwise direction of the drying roller 41. The nozzle tubes 84 are disposed to correspond to the drying roller 41 side of the contact portion of the drying roller 41 and the photosensitive belt 20. When the nozzle tubes 84 spray NORPAR simultaneously, NORPAR can be supplied in the lengthwise direction of the drying roller 41. The pump 87 is intended to pump the NORPAR from the NORPAR tank 81 to the spray nozzle 83, and the valve 89 is intended to adjust the quantity of the NORPAR supplied to the spray nozzle 83. Therefore, it is preferable that the valve 89 is installed in the NORPAR supply line 85 between the pump 87 and the spray nozzle 83.

A printing method of the liquid electrophotographic printing apparatus configured as described above according to still another embodiment of the present invention will be described with reference to FIGS. 7 and 9.

First, also in this embodiment, the printer performs a warm-up operation while rotating the photosensitive belt 20 idly (S30). Then, a print signal is input in a print ready mode after the warm-up operation is completed (S31). Thereafter, the transfer roller 51 and the drying roller 41 are caused to contact the photosensitive belt 20 (S32). In this state, when the photosensitive belt 20 is driven, the rollers 41 and 51 are rotated together with the photosensitive belt 20 while contacting the photosensitive belt 20 (S33). Subsequently, the pump 87 is driven to spray the NORPAR from the NORPAR tank 81 to the drying roller 41 side of the contact portion of the drying roller 41 and the photosensitive belt 20 (S34). At this time, the valve 89 is appropriately controlled to adjust the quantity of sprayed NORPAR at the nozzle tubes 84. For example, when the supply of NORPAR is stopped after NORPAR is sprayed by the nozzle tubes 84 for a few seconds, while NORPAR is restrained from being excessively supplied and flowing over the edge portions of the photosensitive belt 20, an appropriate quantity of NORPAR can be supplied to all of the drying roller 41, the transfer roller 51, and the photosensitive belt 20.

In addition, after NORPAR is supplied as described above, the photosensitive belt 20 is circulated several times, for example, about two or three times (S35). Thus, the drying roller 41, the transfer roller 51, and the photosensitive belt 20 are appropriately wetted by NORPAR, and NORPAR absorption and discharge between them reach a nearly equilibrated state.

As described above, when a developing operation is performed in a state in which NORPAR is supplied to the rollers 41 and 51, and the photosensitive belt 20, errors such as image picking by the drying roller 41 and imperfect image transfer by the transfer roller 51 can be prevented, and the photosensitive belt 20 is prevented from being contaminated by accumulation of newly supplied developer liquid on the photosensitive belt 20.

As described above, with the liquid electrophotographic printing apparatus and the printing method according to the present invention, NORPAR is supplied to the drying roller, the transfer roller, and the photosensitive belt before a developing operation, and the drying roller, the transfer roller, and the photosensitive belt can be freed from dried states. Therefore, errors such as image picking and imperfect image transfer by dried drying roller and transfer roller can be restrained, and, accordingly, an image of better quality can be obtained.

In addition, since the photosensitive belt is first wetted by NORPAR before being exposed to developer liquid, accumulation of toner or an organosol contained in the developer liquid on the photosensitive belt can be prevented, and the usable life of the photosensitive belt can be prolonged.

It is contemplated that numerous modifications may be made to the liquid electrophotographic printing apparatus and method of the present invention without departing from the spirit and scope of the invention as defined in the following claims.

What is claimed is:

1. A liquid electrophotographic printing apparatus comprising a photosensitive medium on one surface of which an image is formed; a drying roller installed to detachably contact the photosensitive medium for absorbing a liquid carrier remaining on the photosensitive medium when contacting the photosensitive medium and a transfer roller which is installed to detachably contact the photosensitive mediuim, to which the image formed on the photosensitive medium is operative to be transferred when the transfer roller contacts the photosensitive medium, and which transfers the image transferred from the photosensitive medium to a recording paper sheet, wherein the printing apparatus further comprises a carrier supply means for supplying a liquid carrier to the drying roller, the transfer roller, and the photosensitive medium, and is adapted so that the rollers and the photosensitive medium can be wetted by the liquid carrier before the image is formed on the photosensitive medium, and liquid carrier absorption and discharge between the rollers and the photosensitive medium are operative to reach equilibrium states.

2. The liquid electrophotographic printing apparatus as claimed in claim 1, wherein the carrier supply means includes:

a carrier tank for storing the liquid carrier;

a carrier applying portion installed in a vicinity of the photosensitive medium for coating the one surface of the circulating photosensitive medium with the liquid carrier stored in the carrier tank;

a carrier spray portion for spraying the liquid carrier stored in the carrier tank to a location between the carrier applying portion and the photosensitive medium; and a carrier recovery portion for recovering the liquid carrier remaining in the carrier applying portion.

3. The liquid electrophotographic printing apparatus as claimed in claim 2, wherein the carrier applying portion includes:

a carrier supply roller rotatably installed in the vicinity of the photosensitive medium for delivering the liquid carrier sprayed on a circumferential surface thereof to the photosensitive medium;

a carrier bath installed below the carrier supply roller to surround the carrier supply roller for receiving the liquid carrier flowing over the circumferential surface of the carrier supply roller; and the carrier recovery portion for recovering the remaining liquid carrier gathering in the carrier bath.

4. The liquid electrophotographic printing apparatus as claimed in claim 2, wherein the carrier recovery portion includes a carrier return path for connecting the carrier applying portion and the carrier tank so that the remaining liquid carrier gathering in the carrier applying portion can be received again in the carrier tank.

5. The liquid electrophotographic printing apparatus as claimed in claim 2, wherein the carrier recovery portion includes:

a carrier recovery tank for recovering the liquid gathering in the carrier gathering in the carrier applying portion; and a carrier recovery path for connecting the recovery tank and the carrier applying portion.

6. The liquid electrophotographic printing apparatus as claimed in claim 2, wherein the carrier spray portion includes:

a carrier supply path for connecting the carrier tank and the carrier applying portion;

a spray nozzle provided at the leading end of the carrier supply path for spraying the carrier supplied from the carrier tank between the carrier applying portion and the photosensitive medium; and a pump installed in the carrier supply path for pumping the liquid carrier in the carrier tank.

7. The liquid electrophotographic printing apparatus as claimed in claim 2, wherein the carrier applying portion is installed between the drying roller and a plurality of development units for forming respective images on the photosensitive medium.

8. The liquid electrophotographic printing apparatus as claimed in claim 1, wherein the carrier supply means includes:

a carrier tank for storing the liquid carrier;

a spray nozzle for spraying the liquid carrier supplied from the carrier tank to the drying roller side of the contact portion of the photosensitive medium and the drying roller;

a carrier supply line for connecting the spray nozzle and the carrier tank;

a pump in the carrier supply line for pumping the liquid carrier stored in the carrier tank; and a valve installed in the carrier supply line for adjusting the supply quantity of the liquid carrier.

9. The liquid electrophotographic printing apparatus as claimed in claim 8, wherein a plurality of nozzle tubes are equidistantly provided at the spray nozzle in a lenghtwise direction of the drying roller.

10. A printing method of a liquid electrophotographic printing apparatus including the steps of warming up the printing apparatus by checking various devices in the printing apparatus while a drying roller and a transfer roller are separated from a photosensitive medium; and developing an electrostatic latent image formed on the photosensitive medium with developer liquid to form an image, wherein the printing method further includes the step of supplying a liquid carrier to the rollers and the photosensitive medium so that the rollers and the photosensitive medium are wetted by the liquid carrier before the developing step.

11. The printing method of a liquid electrophotographic printing apparatus as claimed in claim 10, wherein the carrier supply step includes the steps of:

circulating the photosensitive medium;

causing a carrier supply roller installed in a vicinity of the photosensitive medium to move nearer to the photosensitive medium;

spraying liquid carrier between the carrier supply roller and the photosensitive medium so that the carrier can be absorbed by the photosensitive medium; and causing the drying roller and the transfer roller to contact the photosensitive medium so that the liquid carrier on the photosensitive medium can be absorbed by the rollers.

12. The printing method of a liquid electrophotographic printing apparatus as claimed in claim 10, wherein the carrier supply step includes the steps of:

supplying carrier to an entire surface of the photosensitive medium;

supplying carrier to an entire circumferential surface of the transfer roller after supplying carrier to the photosensitive medium; and supplying carrier to an entire circumferential surface of the drying roller after supplying carrier to the transfer roller.

13. The printing method of a liquid electrophotographic printing apparatus as claimed in claim 12, wherein the step of supplying carrier to the photosensitive medium includes the steps of:

causing a carrier supply roller installed in a vicinity of the photosensitive medium to move nearer to the photosensitive medium;

spraying the liquid carrier which is stored in a carrier tank to a location between the carrier supply roller and the photosensitive medium; and circulating the photosensitive medium at least one time while the transfer roller and the drying roller are separated from the photosensitive medium, wherein the step of supplying carrier to the photosensitive medium is performed so that the entire surface of the photosensitive medium is uniformly wetted by the liquid carrier.

14. The printing method of a liquid electrophotographic printing apparatus as claimed in claim 12, wherein the step of supplying carrier to the transfer roller includes the steps of:

causing the transfer roller to contact the photosensitive medium from which carrier is supplied; and circulating the photosensitive medium at least one time while the transfer roller contacts the photosensitive medium.

15. The printing method of a liquid electrophotographic printing apparatus as claimed in claim 12, wherein the step of supplying carrier to the drying roller includes the steps of:

causing the drying roller to contact the photosensitive medium from which carrier is supplied; and circulating the photosensitive medium at least one time while the drying roller contacts the photosensitive medium.

16. The printing method of a liquid electrophotographic printing apparatus as claimed in claim 11, wherein the carrier supply step further includes the step of balancing the quantities of carrier supplied to the rollers and the photosensitive medium so that carrier absorption and discharge between the rollers and the photosensitive medium can reach equilibrium states.

17. The printing method of a liquid electrophotographic printing apparatus as claimed in claim 16, wherein the carrier balancing step includes the steps of:

stopping the carrier supply to the rollers and the photosensitive medium;

separating the carrier supply roller from the photosensitive medium; and circulating the photosensitive medium at least one time while the transfer roller and the drying roller contact the photosensitive medium.

18. The printing method of a liquid electrophotographic printing apparatus as claimed in claim 10, wherein the carrier supply step includes the steps of:

causing the drying roller and the transfer roller to contact the photosensitive medium;

circulating the photosensitive medium so that the transfer roller and the drying roller can rotate together with the photosensitive medium while contacting the photosensitive medium; and spraying a predetermined quantity of the carrier pumped from a carrier tank to the contact portion of the drying roller and the photosensitive medium.

19. The printing method of a liquid electrophotographic printing apparatus as claimed in claim 18, wherein, in the carrier spraying step, a portion to which carrier is sprayed is the drying roller side of the contact portion of the drying roller and the photosensitive medium.

20. A liquid electrophotographic printing apparatus comprising a photosensitive medium on one surface of which an image is formed; a drying roller installed to detachably contact the photosensitive medium for absorbing a liquid carrier remaining on the photosensitive medium when contacting the photosensitive medium; and a transfer roller which is installed to detachably contact the photosensitive medium, to which the image formed on the photosensitive medium is operative to be transferred when the transfer roller contacts the photosensitive medium, and which transfers the image transferred from the photosensitive medium to a recording paper sheet, wherein the printing apparatus further comprises a carrier supply mechanism which supplies a liquid carrier to the drying roller, the transfer roller, and the photosensitive medium, and is adapted so that the rollers and the photosensitive medium can be wetted by the liquid carrier before the image is formed on the photosensitive medium, and liquid carrier absorption and discharge between the rollers and the photosensitive medium are operative to reach equilibrium states.

* * * * *